United States Patent [19]

Nutter

[11] 4,407,653

[45] Oct. 4, 1983

[54] APPARATUS FOR HEATING SOLID HEAT-CARRYING BODIES

[75] Inventor: John F. Nutter, Encino, Calif.

[73] Assignee: Tosco Corporation, Los Angeles, Calif.

[21] Appl. No.: 322,894

[22] Filed: Nov. 19, 1981

[51] Int. Cl.[3] ..... F27B 15/00; F26B 17/12

[52] U.S. Cl. ..... 432/215; 34/167; 414/160; 432/95

[58] Field of Search ..... 432/215, 95; 214/160, 214/208; 34/165, 167

[56] References Cited

U.S. PATENT DOCUMENTS

| | | | |
|---|---|---|---|
| 2,201,738 | 5/1940 | Nere | 75/34 |
| 2,505,257 | 4/1950 | Quigg | 432/215 |
| 2,614,824 | 10/1952 | Weber | 432/215 |
| 3,190,470 | 6/1965 | Ritter | 414/160 |
| 3,595,540 | 7/1971 | Whitcomb | 432/215 |
| 4,193,760 | 3/1980 | Vawter et al. | 34/167 X |
| 4,211,316 | 7/1980 | Rymarchyk et al. | 414/208 |

*Primary Examiner*—John J. Camby

*Attorney, Agent, or Firm*—Poms, Smith, Lande & Rose

[57] ABSTRACT

An improved apparatus and method for feeding heat carrying solids into a solids heater. A feed conduit is provided which may be removably attached to a solids heater shell. The mounted feed conduit includes an outlet portion disposed within a heating chamber which is defined by the heater shell. A jacket tube is sealed around the feed conduit to provide cooling against high temperatures. Further, inlets and outlets are provided for introducing and removing cooling medium from the cooling zone defined by the space between the jacket tube and feed conduit. The feed conduits are removably attached to the heater shell by way of mounting tubes located in the heater shell roof. For inclined heater shell roofs, the length of the mounting tubes are varied to provide common elevational mounting of a single uniform removable feed conduit.

8 Claims, 3 Drawing Figures

10
12
14
16
18
20
22
24
26
28
30
32
34
36
38
48
52
II

APPARATUS FOR HEATING SOLID HEAT-CARRYING BODIES

BACKGROUND OF THE INVENTION

The present invention relates generally to devices for heating solids. The solids being heated are heat exchange bodies such as metallic or ceramic balls or pebbles, which are preferably used in rotating retorts for heating and crushing materials which are being processed. More specifically, the present invention relates to an improved apparatus and method for feeding the heat exchange bodies to the solids heater device.

Solid heat exchange bodies, referred to hereinafter as solids, are used in the pyrolytic processing of oil shale and other solid carbonaceous materials. The solids are utilized to heat the carbonaceous material (e.g. oil shale) by exchanging their heat to the material being processed by means of intimate contact therewith. After the carbonaceous materials are heated to the desired temperature, the solids are separated from the carbonaceous material and returned to a device which reheats the solid heat carrying bodies. Examples of such solids heating devices are disclosed in U.S. Pat. Nos. 3,595,540 and 4,193,760. These solids heating devices are commonly referred to as solids heaters or ball heaters.

Solids heaters generally include a heater shell which defines a heating chamber having a bottom, sides and a top. A flow of hot flue gas is introduced through the top of the heater shell to heat solids which are concurrently introduced into the heating chamber. The solids are introduced into the heating chamber through feed conduits which pass through the heater shell top.

After the solids are reheated to desired temperatures, various disengager and separation means are provided for separating the heated solids from the concurrently flowing flue gas. The separated or disengaged reheated solids are then passed back to the retort or other process vessel where heating of carbonaceous material is desired.

Due to the high temperatures necessary to provide desired reheating of solids, problems have been experienced with overheating or failure of various solids heater components. For example, solids heaters typically include a plurality of solids feed pipes or feed pipes or feed conduits arranged at spaced locations around the heater shell top for feeding solids to the heating chamber. The feed pipes include an inlet portion on the outside of the heater shell and an outlet portion disposed inside the heater shell within the heating chamber. The feed pipes are typically made of relatively expensive temperature resistant alloy steels. The feed pipes are welded to the heater shell top or roof in order to secure them into place. Since heater shells are typically made from carbon steel, the welding of these different types of materials to each other require special techniques that are very expensive. In addition, problems are presented in that stress at the weld joints due to different coefficients of expansion of the materials results in stress development and possible fracture at the weld locations during heating and cooling of the solids heater.

A further problem experienced with solids feed pipes is the intermittent blockage and interruption of solids flow through the feed pipe. During prolonged operation of solids heaters, partial or total blockage of the feed pipes may occur. Also, blockages and process disruptions in other portions of the solids circuit may cause the flow of solids through the feed pipes to be interrupted. When the feed pipes become blocked and when the flow of solids through the feed pipes is interrupted, the feed pipes may be subjected to overheating. This results in possible warpage and partial melting of the feed pipe.

It would therefore be desirable to provide a method and apparatus wherein the feed pipe or conduit is connected to the heater shell by some means other then welding. It is further desirable that the feed pipe be easily and quickly removed for cleaning and removal of solids blockages when plugging occurs and further be provided with means for protecting the pipes from overheating due to partial or total blockage or other solids flow interruptions.

SUMMARY OF THE INVENTION

In accordance with the present invention, an improved solids heating apparatus is provided in which the solids feed conduit can be quickly and easily attached and removed from the solids heater shell. Further, the solids feed conduit is provided with means for insulating or cooling the conduit to prevent overheating in the event of solids flow blockage or interruption.

The present invention is based upon a solids feed conduit which includes an input portion designed for receiving solids and an output portion designed to deliver solids to the heating chamber of a solids heater. The feed conduit includes means for removable attachment to the heater shell so that the feed conduit output portion, when attached, is disposed within the heating chamber.

As a feature of the present invention, the solids feed conduit is provided with means for cooling the portion of the feed conduit disposed within the heating zone. Cooling is preferably provided by an insulating tube jacket surrounding the feed conduit through which a cooling or insulating medium is passed.

The means for removably attaching the solids feed conduit to the solids heater preferably includes a mounting tube having a top end and a bottom end. The bottom end is integrally attached to the heater shell with the top end including a flange for receiving the feed conduit. Further, the mounting tube has a sufficient diameter so that the feed conduit may be passed therethrough. Many times, it is desirable to incline the top or roof of the solids heater shell to provide optimum introduction of hot flue gas into the heating chamber. It is also desirable that the outlet portions or ends of the feed conduits be level. As a feature of the present invention, the lengths of the mounting tubes are varied according to their location on the inclined heater shell roof so that the feed conduit outlets are level with each other and not inclined.

The present invention therefore provides for a solids feed conduit which is not welded or otherwise permanenetly attached to the solids heater shell. This unique attachment prevents the development of the above mentioned problems regarding difficulties in welding and uneven stress. Further, the feed conduits may be quickly and conveniently removed when unplugging of solids blockage is necessary or when repair or replacement is required. Further, the feed conduits are insulated by cooling means to prevent heat damage due to possible localized overheating.

The above discussed and many other features and attendant advantages of the present invention will become apparent as the invention becomes better understood by reference to the following detailed description when considered in conjunction with the accompanying drawings.

DETAILED DESCRIPTION OF THE INVENTION

Figure 1:
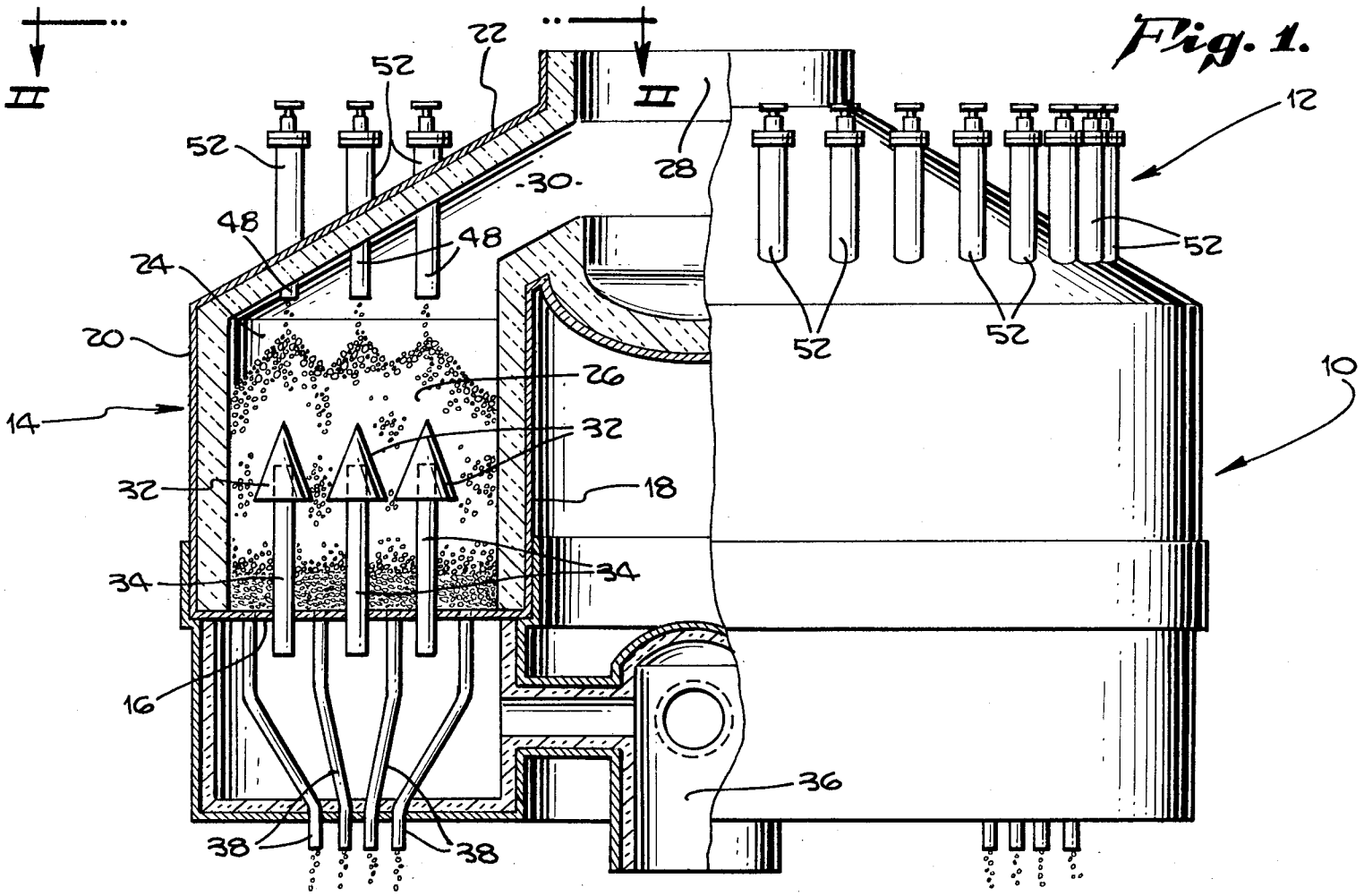
FIG. 1 is a partial sectional view of an exemplary solids heating device showing a preferred embodiment of the feed conduits in accordance with the present invention.

In FIG. 1, a solids heater is shown generally at 10. The solids heater 10 is the same solids heater as disclosed in U.S. Pat. No. 4,913,760 except for the inclusion of the preferred feed conduits in accordance with the present invention. The preferred feed conduits are shown generally at 12. The contents of U.S. Pat. No. 4,913,760 is hereby incorporated by reference.

The solids heater 10 includes a heater shell 14. The heater shell 14 includes a bottom 16, sides 18 and 20 and a top or roof 22. The heater shell 14 defines a heating chamber 24.

As is conventional, partially cooled heat carrying solids are passed into the heating chamber to form a bed of solids 26. Heating of the solids is provided by passing hot flue gas through gas inlet 28, passageway 30 and into the heating chamber 24. The bed of solids 26 is reheated by the hot flue gas to desired temperatures. Disengagers 32 are provided for separating the heated solids from the flue gas. The flue gas exits the heating chamber 24 through gas exit pipes 34 and passes out of the solids heater 10 through gas outlet 36. The heated solids flow by gravity through collector tubes 38. The heated solids are passed out of the solids heater 10 and recyled back to a retort or other processing apparatus.

Figure 2:
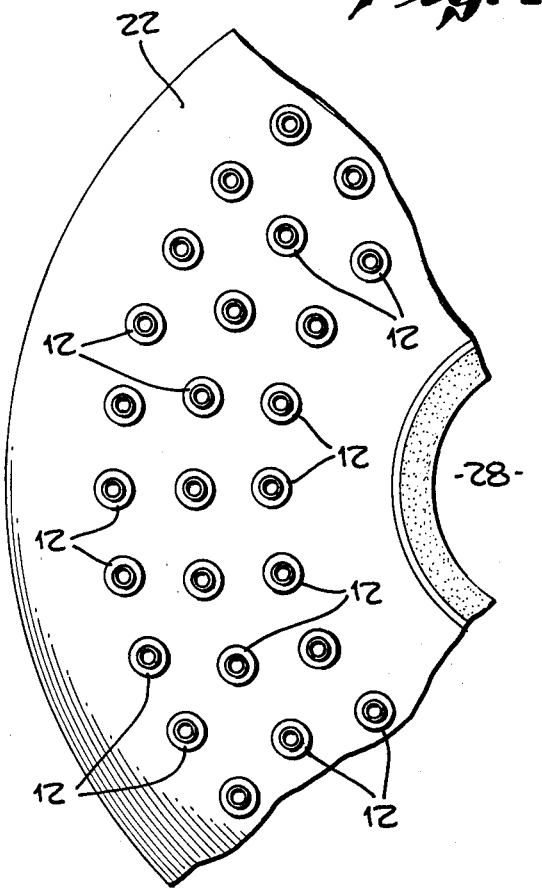
FIG. 2 is a view of FIG. 1 taken in the II—II plane.

In accordance with the present invention, removable feed conduits 12 are provided for introducing solids into the heating chamber 24. It is possible that a solids heater could be designed in which only one feed conduit is utilized. However, it is preferred that a plurality of feed conduits be provided at spaced locations along the heater shell top 22 to promote uniform introduction of solids into the heating chamber 24. The particular arrangement or configuration of feed conduits is not critical. For circular or cylindrical heater shells 14, it is preferred that concentric circles of equally spaced feed conduits 12 be provided in the heater shell top 22. As best shown in FIG. 2, three feed conduit circles are provided extending around the heater shell top. Of course, more or less concentric circles of feed conduits may be utilized when desired and equal spacing, although it is desirable, is not absolutely necessary.

Figure 3:
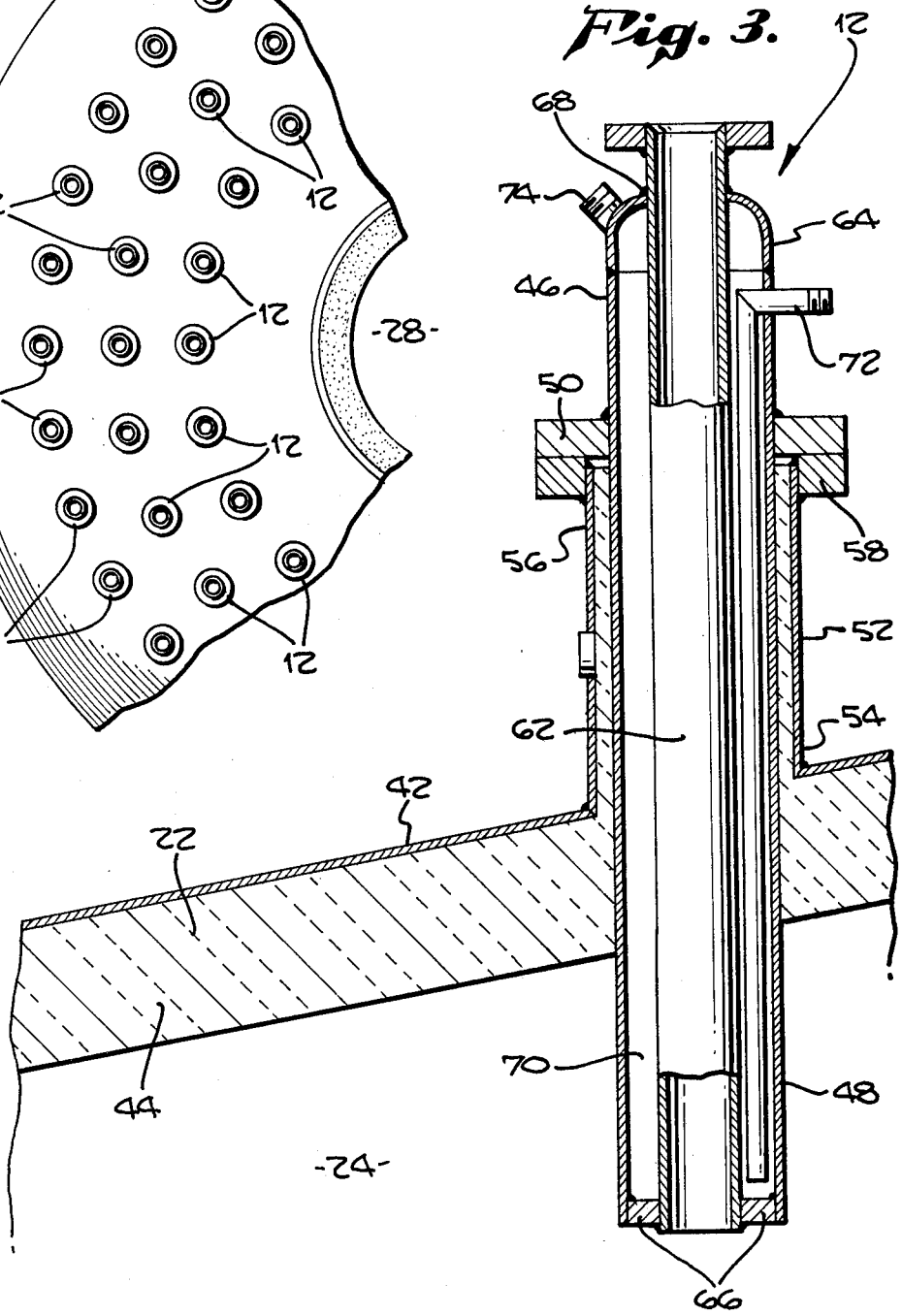
FIG. 3 is a detailed partial sectional view of a preferred feed conduit.

Referring now to FIG. 3, a preferred removable feed conduit is shown generally at 12. The feed conduit 12 is mounted on the heater shell top 22. The heater shell top 22 includes outer carbon steel layer 42. A layer of insulating material 44 is provided to protect outer shell layer 42.

The feed conduit 12 includes an inlet portion 46 and an outlet portion 48. The outlet portion 48 is disposed within the heating chamber 24. Means for removably attaching the feed conduit 12 to the heater top 22 is provided by a circular flange 50 which is securely attached to the feed conduit 12 by welding. The removable attachment further includes a mounting tube 52 which includes a bottom end 54 that is securely attached to metal layer 42 by welding or other conventional means. The mounting tube 52 also includes a top end 56 on which is securely attached a circular flange 58. The circular flange 50 is adapted to sealably seat upon the flange 58. Further, means for releasably securing the flanges together (not shown) may be provided by either clamps, bolts or any other conventional means. The mounting tube 52 is preferrably made from a heat resistant metal which is compatible with the heater shell metal for welding and which has a similar coefficient of expansion. For heater shells made from carbon steel, the preferred mounting tube 52 is also made from carbon steel.

In accordance with the present invention, means are provided for cooling the heat conduit 12 as follows. The feed conduit 12 includes a central feed pipe 62 which is surrounded by a jacket tube 64. The jacket tube 64 is sealed to the central feed pipe 62 at its lower end by plates 66. At the central feed pipe 62 upper end, the jacket tube is formed inwardly toward the central feed pipe 62 and sealed thereto as shown at 68. The area between the central feed pipe 62 and the jacket tube 64 defines an annular zone 70. It is necessary that a cooling medium or insulating medium be passed through the annular zone 70, the preferred means for cooling include a cooling medium inlet 72 and a cooling medium outlet 74 to allow passage of cooling mediums through the annular zone as required.

Various cooling mediums such as water or other heat exchange liquids or gases are passed into inlet 72 where they are circulated around the central feed pipe 62 and subsequently passed out through outlet 74. The jacket tube 64 preferably surrounds all of the central feed pipe 62; however, it may be desirable in certain circumstances only to provide a jacket tube 64 for surrounding and insulating or cooling only that portion of the cnetral feed pipe 62 which is disposed within the heating chamber 24.

The temperatures usually experienced by the feed conduit outlet 48 disposed within the heating chamber is kept below undesirable levels due to the continuous heat absorption by the cooling medium as it passes through the conduit 12. However, occasional plugging or blockage of the central feed pipe 62 or interruption of the flow of solids therethrough results in increased temperatures and possible damage to the feed conduit. The cooling means as discussed above is particularly important in preventing temperature increases and the resultant damage to the feed conduit. In operation, cooling medium will be circulated through the feed conduits 12 so the temperature of the conduit cannot rise above predetermined levels due to flow blockage or otherwise. Of course, the flow of cooling medium through the feed conduit cooling means will be continuous.

As was previously noted, many solids heaters have heater shell tops which are inclined, among other reasons, to optimize hot flue gas introduction into the heating chamber. It is also desirable that the outlet ends of the feed conduits be level in the heating chamber. It is preferred that in producing feed conduits in accordance with the present invention, that the feed conduits all have a uniform length. As a particular feature of the present invention, in order to maintain the output ends of the feed conduits at the same elevation within the heating chamber 24, the length of the mounting tubes 52 are varied according to the location of the mounting tube on the inclined heater shell top 22. As shown in FIG. 1, the length of the mounting tubes 52 increases with increasing radially outward location of the mounting tube. In this way, it is possible to interchange uniform and standardized feed conduits between various mounting tube locations while still maintaining the required uniform elevation of the feed conduit outlet ends. This is a particularly advantageous feature since it allows the more economic production of a single uniform feed conduit which may be quickly installed or removed and relocated at any location on an inclined heater shell top.

Having thus described exemplary embodiments of the present invention, it should be noted by those skilled in the art that the within disclosures are exemplary only and that various other alternatives, adaptions and modifications may be made within the scope of the present invention. Accordingly, the present invention is not limited to the specific embodiments as illustrated herein.

What is claimed is:

1. An apparatus for heating solids comprising:

a heater shell having a roof, sides and a bottom defining a solids heating chamber; a removable feed conduit passing through said heater shell, said conduit having an inlet portion outside said heating chamber, an outlet portion inside said heating chamber and a mid portion therebetween, wherein solids are passed through said feed conduit into said heating chamber for heating;

a mounting tube having a bottom end integrally attached to said heater shell and a top end, said mounting tube having an inside diameter large enough for said feed conduit to pass therethrough;

a first flange extending radially outward from the mounting tube top end;

a second flange extending radially outward from said feed conduit mid portion, said second flange being adapted to releasably seat upon said first flange to position said feed conduit within said mounting tube and heating chamber;

means for heating said solids within said heating chamber; and means for removing the heated solids from the heating chamber.

2. An apparatus according to claim 1 wherein a plurality of feed conduits and mounting tubes are provided on said heater shell roof for introducing solids into said heating chamber.

3. An improved apparatus according to claim 2 in which said feed conduits are all substantially the same length and have said second flange located at the same position along said feed conduit.

4. An apparatus according to claim 2 in which the heater shell roof is inclined and wherein the outlet portions of the feed conduits are all positioned at the same vertical height relative said disengager means within said heating chamber by varying the length of said mounting tubes along the inclined roof of said heater shell.

5. An apparatus according to claim 1 including means for cooling the outlet portion of said feed conduit disposed within said heating chamber.

6. An improved apparatus according to claim 5 wherein said cooling means includes a jacket tube surrounding said feed conduit outlet portion and defining a cooling zone between said feed conduit and said jacket tube.

7. An improved apparatus according to claim 6 wherein said jacket tube includes a cooling medium inlet and a cooling medium outlet for passing cooling medium through said cooling zone.

8. An apparatus according to claim 1 wherein said means for heating said solids includes a hot gas inlet for introducing hot gas into said heating chamber for heating said solids and a gas outlet associated with the heater shell bottom for removing partially cooled gas from said heating chamber, said apparatus further comprising:

individual disengager means associated with each gas outlet such that solids are deflected by said disengager means relative said hot flue gas outlets and are prevented from entering the gas outlet;

means for coaxially mounting said gas outlets downstream of and displaced from said feed conduit outlet portion; and means for positioning said disengager means intermediate the gas outlet and the feed conduit outlet portion.

* * * * *